US008740489B2

(12) United States Patent
Kageyama et al.

(10) Patent No.: US 8,740,489 B2
(45) Date of Patent: Jun. 3, 2014

(54) LIQUID APPLICATOR

(75) Inventors: Hidehei Kageyama, Kawagoe (JP); Yoshio Noguchi, Kawagoe (JP); Yoshiyuki Sawayama, Kawagoe (JP)

(73) Assignee: Kotobuki & Co., Ltd., Saitama (JP)

( * ) Notice: Subject to any disclaimer, the term of this patent is extended or adjusted under 35 U.S.C. 154(b) by 740 days.

(21) Appl. No.: 12/523,032

(22) PCT Filed: Jan. 10, 2008

(86) PCT No.: PCT/JP2008/050211

§ 371 (c)(1),
(2), (4) Date: Jul. 13, 2009

(87) PCT Pub. No.: WO2008/084833

PCT Pub. Date: Jul. 17, 2008

(65) Prior Publication Data

US 2010/0003063 A1 Jan. 7, 2010

(30) Foreign Application Priority Data

Jan. 12, 2007 (JP) ..... 2007-004905

(51) Int. Cl.
*B43M 11/06* (2006.01)

(52) U.S. Cl.
USPC ..... 401/184; 401/176; 401/183; 401/182

(58) Field of Classification Search
USPC ..... 401/171, 182–184, 156, 176, 170, 12
See application file for complete search history.

(56) References Cited

U.S. PATENT DOCUMENTS

| | | | | | |
|---|---|---|---|---|---|
| 220,483 | A | * | 10/1879 | Madeheim | 401/170 |
| 1,398,800 | A | * | 11/1921 | Regero | 401/170 |
| 1,502,538 | A | * | 7/1924 | Anderson | 401/170 |
| 1,739,325 | A | * | 12/1929 | Pearson | 401/170 |
| 1,743,786 | A | * | 1/1930 | Markstein | 401/108 |
| 1,778,195 | A | * | 10/1930 | Moses | 401/170 |
| 1,874,024 | A | * | 8/1932 | Ashley | 401/170 |

(Continued)

FOREIGN PATENT DOCUMENTS

| | | |
|---|---|---|
| DE | 3122516 A1 | 12/1982 |
| JP | 61-61074 | 4/1986 |
| JP | 14-12015 | 8/1989 |
| JP | 3-29391 | 3/1991 |

OTHER PUBLICATIONS

European Search Report for related application No. 08703075.5; report dated May 20, 2011.

*Primary Examiner* — David Walczak
*Assistant Examiner* — Bradley Oliver
(74) *Attorney, Agent, or Firm* — Miller, Matthias & Hull LLP

(57) ABSTRACT

There is provided a liquid applicator allowing a liquid to be easily replenished and replaced, as well as capable of containing a large amount of liquid. The liquid applicator includes a main body provided with a tank inside thereof, a tip shaft that is coupled to the tip end side of the main body, and a brush that is fixed in the tip shaft and projecting from the tip end of the tip shaft. A liquid may be sucked into a tank by releasing the coupling of the main body and the tip shaft, sinking a tip end opening of the main body in the liquid, and sliding a sliding cylinder attached to the rear portion of the main body.

8 Claims, 5 Drawing Sheets

(56) References Cited

U.S. PATENT DOCUMENTS

| | | | | |
|---|---|---|---|---|
| 2,035,372 | A | 3/1936 | Mohns | |
| 2,743,042 | A * | 4/1956 | Burgin | 222/191 |
| 3,432,245 | A * | 3/1969 | Hudson | 401/132 |
| 4,813,870 | A * | 3/1989 | Pitzen et al. | 401/184 |
| 5,042,955 | A * | 8/1991 | Moscatelli | 401/269 |
| 5,755,523 | A * | 5/1998 | Seydel | 401/176 |
| 5,921,692 | A * | 7/1999 | Weber | 401/184 |
| 6,238,120 | B1 * | 5/2001 | Mark | 401/265 |
| 2002/0114658 | A1 * | 8/2002 | Allen et al. | 401/176 |
| 2005/0169695 | A1 * | 8/2005 | Noguchi | 401/277 |
| 2006/0239758 | A1 * | 10/2006 | Di Paolo | 401/153 |

* cited by examiner

LIQUID APPLICATOR

CROSS-REFERENCE TO RELATED APPLICATION

This application is a U.S. National Phase of International Patent Application No. PCT/JP2008/050211, filed on Jan. 10, 2008, which claims priority under the Paris Convention to Japanese Patent Application No. JP 2007-004905, filed on Jan. 12, 2007.

FIELD OF THE DISCLOSURE

The present invention relates to a liquid applicator for applying a liquid and more particularly to a liquid applicator allowing a liquid to be freely replenished and replaced with another liquid.

BACKGROUND OF THE DISCLOSURE

A conventional liquid applicator contains a liquid to be applied in a tank provided inside thereof so that the liquid can be applied from a tip end applicator body on an object to be applied.

In such conventional liquid applicator, a liquid in the tank cannot be replenished or replaced with another liquid. Therefore, it is not possible to change a type of the liquid in the tank and once the liquid runs out, there is no option but to throw away, that is, the container is of throwaway type.

To address the above defects, Japanese Patent Application Laid-open No. 11-221994 discloses a portable applicator including: an outer sheath; a liquid holding cotton holding sheath, which is provided inside the outer sheath, for holding a liquid holding cotton inside thereof; and a rubber tail cap detachably attached to the rear end of the outer sheath, wherein the rear end of the rubber tail cap is closed to form an air chamber inside thereof, and the rear end of the liquid holding cotton holding sheath is inserted into a central opening of the rubber tail cap communicating with the air chamber and fixed therein. To replenish the liquid, the rubber tail cap is detached from the outer sheath together with the liquid holding cotton holding sheath and the air chamber of the rubber tail cap functions as a dropper to soak the liquid holding cotton with a liquid through the tip end portion of the liquid holding cotton holding sheath, whereby the liquid can be repeatedly replenished.

SUMMARY OF THE DISCLOSSURE

However, unfortunately, with the applicator described in the above patent application, the liquid can be replenished but cannot be replaced easily, and further, the portable applicator has to be longer in order to hold a larger amount of liquid.

The present invention is accomplished in view of the above defects and the object thereof is to provide a liquid applicator allowing a liquid to be easily replenished and replaced, as well as capable of containing a large amount of liquid.

To accomplish the above object, a liquid applicator according to an aspect of the present invention includes a main body provided with a tank inside thereof; and a tip end applicator body that is arranged in front of the main body and that is capable of applying a liquid on an object to be applied. A sliding cylinder that can be pushed or pulled from outside is attached at the rear of the main body so as to be slidable with respect to the main body, whereby the volume capacity of the tank is variable by sliding the sliding cylinder with respect to the main body.

According to an aspect of the present invention, the volume capacity of the tank can be varied by pushing or pulling the sliding cylinder to slide the sliding cylinder with respect to the main body. Accordingly, it is possible to expand the volume capacity of the tank so as to make negative pressure in the tank, which causes a liquid to be sucked into the tank and thus the liquid is introduced into the tank. In this manner, a liquid can be replenished into the tank. On the other hand, it is possible to reduce the volume capacity of the tank so as to make positive pressure in the tank, which causes a liquid in the tank to be discharged. Therefore, liquid replacement is also easily performed with combination of discharging and introducing.

In addition, the whole length of the liquid applicator can be decreased to improve its portability by sliding the sliding cylinder to reduce the volume capacity of the tank while not in use. While in use, the volume capacity of the tank can be increased by sliding the sliding cylinder so as to contain a large amount of liquid. Further, since the whole length of the liquid applicator can be increased, the liquid applicator is easy to grip by hand so as to improve its handleability.

According to an aspect of the present invention, the tip end applicator body is fixed in a tip shaft coupled to the tip end side of the main body and the main body and the tip shaft are coupled with each other in a releasable manner such that the tip end opening formed at the tip end of the main body can be exposed.

When the coupling between the main body and the tip shaft is released from each other, the tip end opening of the main body is exposed whereby a liquid can be directly introduced or discharged through the tip end opening.

According to an aspect of the present invention, the main body is provided with a flexible portion, at least a part of which adjoins the tank, for allowing the volume capacity of the tank to be varied by pushing the flexible portion.

In order to apply a liquid from the tip end applicator body while in use of the liquid applicator, the flexible portion is pushed to reduce the volume capacity of the tank and thus a liquid can be supplied into the tip end applicator body.

DETAILED DESCRIPTION OF THE DISCLOSURE

The present invention will be described hereinafter with reference to the drawings.

Figure 1:
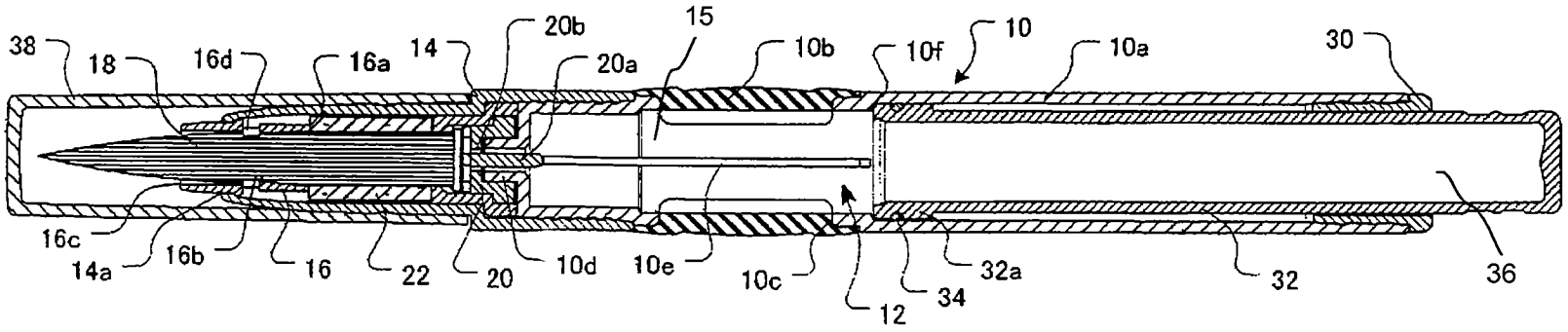
FIG. 1 is a whole longitudinal sectional view showing an embodiment of a liquid applicator according to the present invention.
Figures 2, 2A, 2B, 2C:
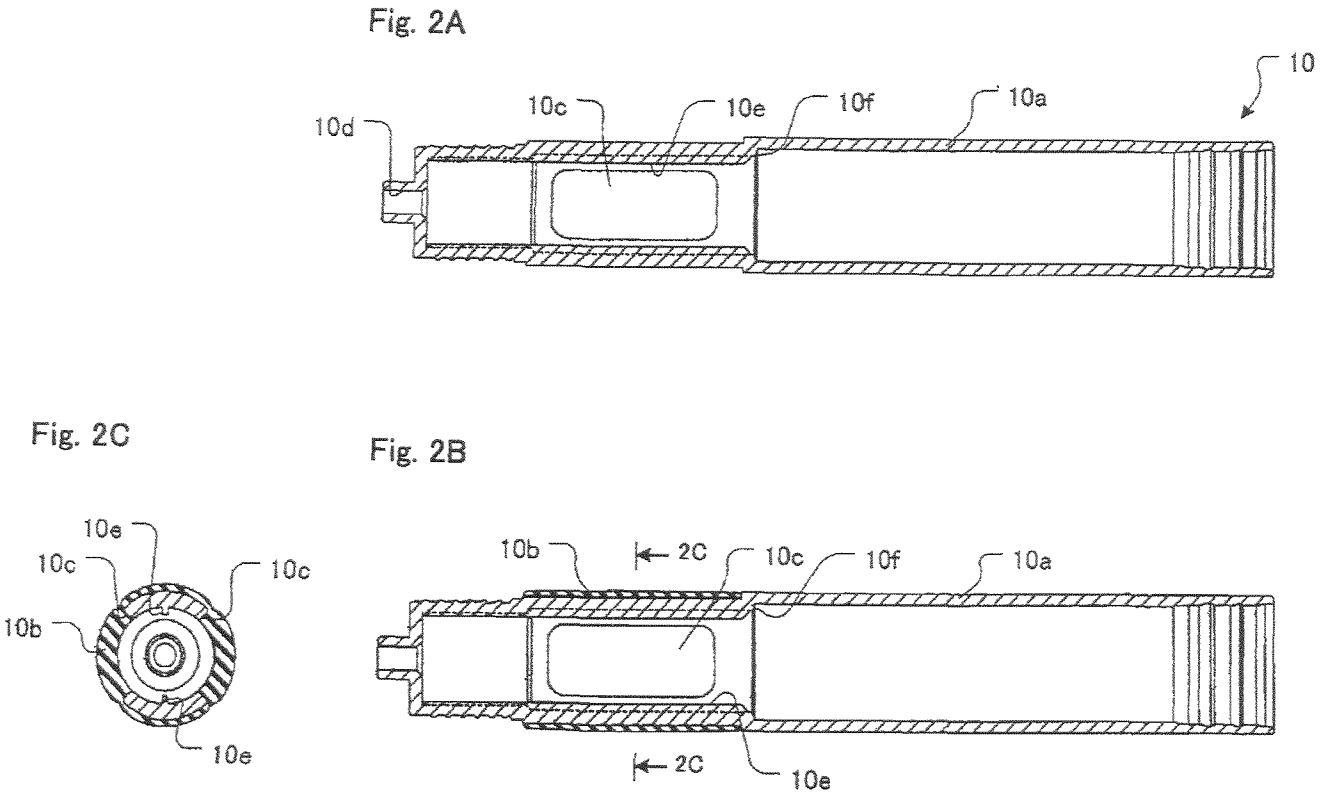
FIG. 2A is a longitudinal sectional view of a main body shaft portion of the main body in FIG. 1.
FIG. 2B is a longitudinal sectional view of the main body in FIG. 1 in a state where a main body shaft portion and a flexible portion are unified.
FIG. 2C is a sectional view taken along line 2C-2C of FIG. 2B.

FIG. 1 is a whole longitudinal sectional view showing an embodiment of a liquid applicator according to the present invention. As shown in FIG. 1, a liquid applicator according to an embodiment of the present invention has a tank 12 for containing a liquid therein. The tank 12 comprises a first tank portion 15 and a second tank portion 36. The liquid applicator further has a main body 10 which includes a main body shaft portion 10*a* that is hard, and a flexible portion 10*b* that is soft and provided on a circumference of a part of the main body shaft portion 10*a* . The main body shaft portion 10*a* and the flexible portion 10*b* may be formed as separated members, or may be formed as an integrally molded member by two-color molding or insert molding.

A side opening 10*c* is formed in the part of the main body shaft portion 10*a* where the flexible portion 10*b* is provided. The flexible portion 10*b* enters the side opening 10*c* and the entered part of the flexible portion 10*b* adjoins the tank 12 inside the main body 10.

A tip shaft 14 is releasably coupled to the main body 10 on the side of a tip end opening 10*d* by threading. A tip tool 16 is arranged inside the tip shaft 14.

The tip tool 16 has a rear end abutting a tip end surface of the main body shaft portion 10*a* and a tip end projecting out from a tip end opening 14*a* of the tip shaft 14. A brush 18, which is a tip end applicator body, is inserted into the tip tool 16 through the rear end thereof and a tip end of the brush 18 projects out from a tip end opening 16*c* of the tip tool 16.

Figure 3:
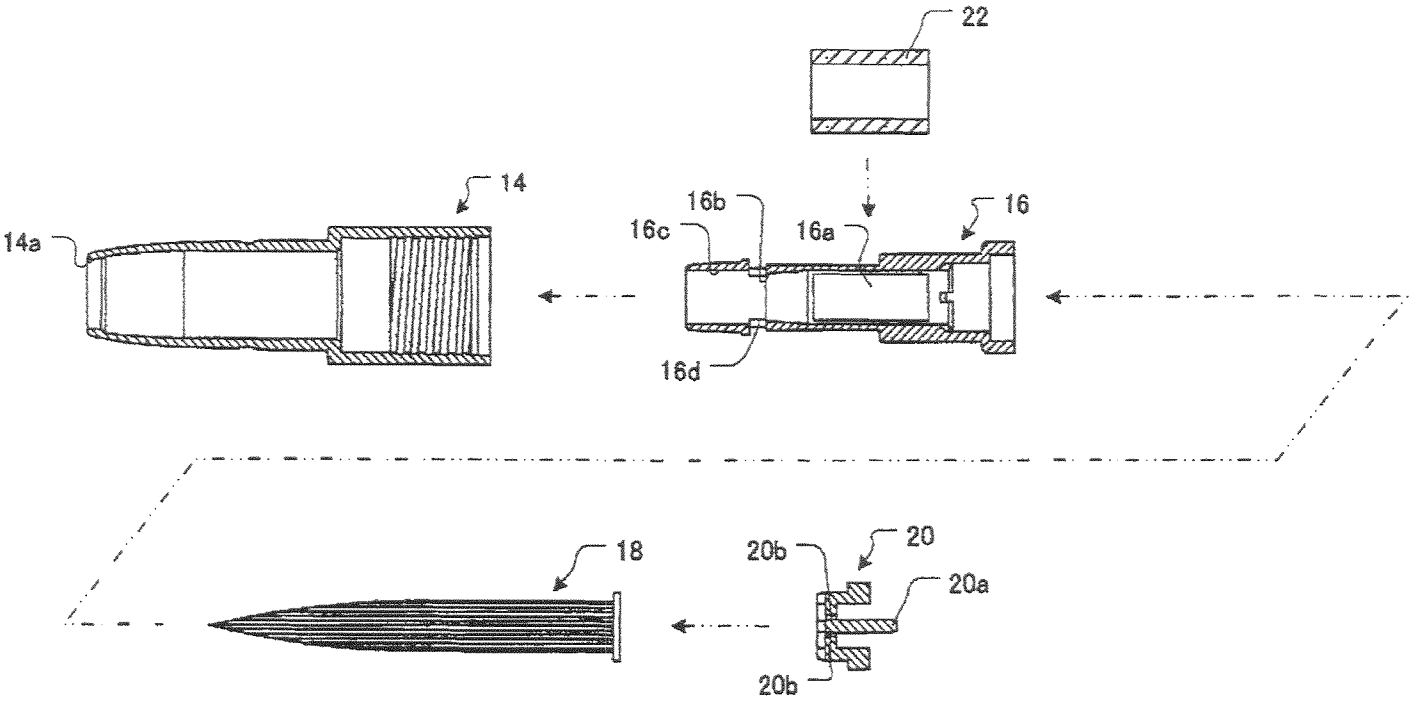
FIG. 3 is an exploded sectional view of a tip shaft unit.

An inwardly projecting portion 16*b* that is of annular shape and projecting inwardly is formed in the tip tool 16 as shown in FIG. 3. The inwardly projecting portion 16*b* restricts expansion of the tip end of the brush 18. In addition, a sponge-like liquid absorber 22 for absorbing an excess liquid is inserted into the tip tool 16 through a side hole 16*a* formed in the tip tool 16. The brush 18 passes through inside the liquid absorber 22. In the tip tool 16, a second side hole 16*d* is formed closer to the tip end than the inwardly projecting portion 16*b* .

Further, an inner stopper 20 is inserted into the tip tool 16 from the rear of the brush 18 and fixed to the tip tool 16. A columnar portion 20*a* is formed on the rear end of the inner stopper 20. The columnar portion 20*a* extends into the main body 10 passing through the tip end opening 10*d* of the main body 10. A through-hole 20*b* for communicating with the brush 18 is formed around a base part of the columnar portion 20*a*. One or more of the through-hole 20*b* may be formed. The brush 18 and the liquid absorber 22 are integrally attached to the tip tool 16 with the inner stopper 20 and further, the tip tool 16 is fixed in the tip shaft 14, whereby these components are integrally attached together to form a tip shaft unit. The tip shaft unit may include other components such as a valve.

A sliding cylinder 32 with the rear end closed is attached to the rear of the main body 10 so as to be slidable with respect to the main body 10. The first tank portion 15 is defined by a portion of an interior of the main body 10 that extends forward from a tip end of the sliding cylinder 32 slidably attached to the rear of the main body 10. The second tank portion 36 is defined in an interior of the sliding cylinder 32. The tip end of the sliding cylinder 32 is opened, so that the first tank portion 15 and the second tank portion 36 communicate with each other. An O-ring 34 is fitted around a circumferential surface of a large diameter portion 32*a* formed at the tip end of the sliding cylinder 32. With the O-ring 34 slidably contacting with the inner circumferential surface of the main body 10, water tightness of the sliding cylinder 32 with the main body 10 is secured.

A tail cap 30 is attached to the rear end of the main body 10 and the sliding cylinder 32 is slidable with respect to the main body 10 in a range where the large diameter portion 32*a* of the sliding cylinder 32 moves between a step portion 10*f*, which is formed on the inner circumferential surface of the main body shaft portion 10*a*, and the tail cap 30.

The volume capacity of the tank 12 is variable by sliding the sliding cylinder 32 with respect to the main body 10. That is, when the sliding cylinder 32 is pushed into the main body 10, a volume of the second tank portion 36 remains unchanged and a volume of the first tank portion 15 can be reduced and, when the sliding cylinder 32 is pulled out of the main body 10, the volume of the second tank portion 36 remains unchanged and the volume of the first tank portion 15 can be increased. Ribs 10*e* for improving fluidity of the liquid in the tank 12 are formed on the inner circumferential surface of the main body 10 that defines the first tank portion 15.

Further, a cap 38 for protecting the tip end of the brush 18 while not in use is detachably attached to the tip shaft 14.

Figure 5A:
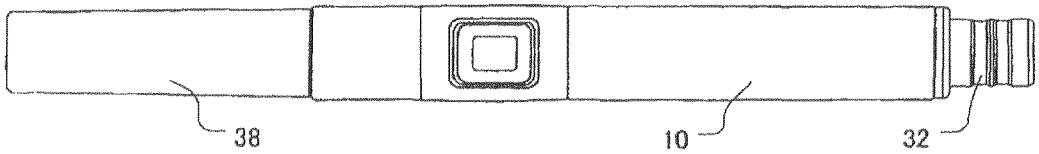
FIG. 5A is a view to illustrate a liquid applicator according to the present invention while not in use.

An operation of the liquid applicator configured as described above will be described. While not in use, the tank 12 can be empty. At this time, the sliding cylinder 32 can maximally retract into the main body 10 as shown in FIG. 5A to decrease the whole length of the liquid applicator, thereby improving its portability.

Figure 5B:
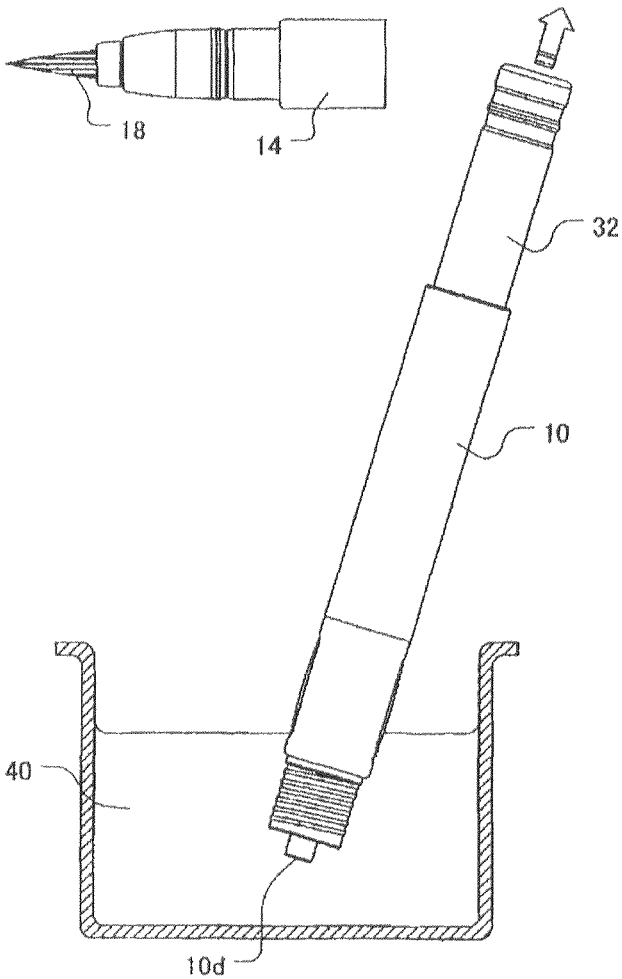
FIG. 5B is a view to illustrate a liquid applicator according to the present invention while sucking a liquid.

While in use, a liquid 40 to be applied (dissolved paint when painting a water color, for example) is prepared as shown in FIG. 5B. The threaded coupling of the main body 10 and the tip shaft 14 is released, the tip end portion including the tip end opening 10*d* of the main body 10 is sunk in the liquid, and the sliding cylinder 32 is pulled rearward while holding the main body 10. Accordingly, the volume capacity of the tank 12 in the liquid applicator is expanded so as to make negative pressure, which causes the liquid to be sucked into the tank 12. In order to suck more, the tip end portion of the main body 10 is once taken out from the liquid, and the main body 10 is then held with its tip end opening 10*d* facing up, thereby causing a portion of the prepared liquid, which has been first sucked in the first tank portion 15 of the tank 12, to flow toward the second tank portion 36. In this condition, the sliding cylinder 32 is pushed forward to retract into the main body, thereby evacuating air inside the tank 12 through the tip end opening 10*d*. Then, the tip end opening 10*d* of the main body 10 is sunk in the liquid again to repeat the sucking operation.

Figure 4:
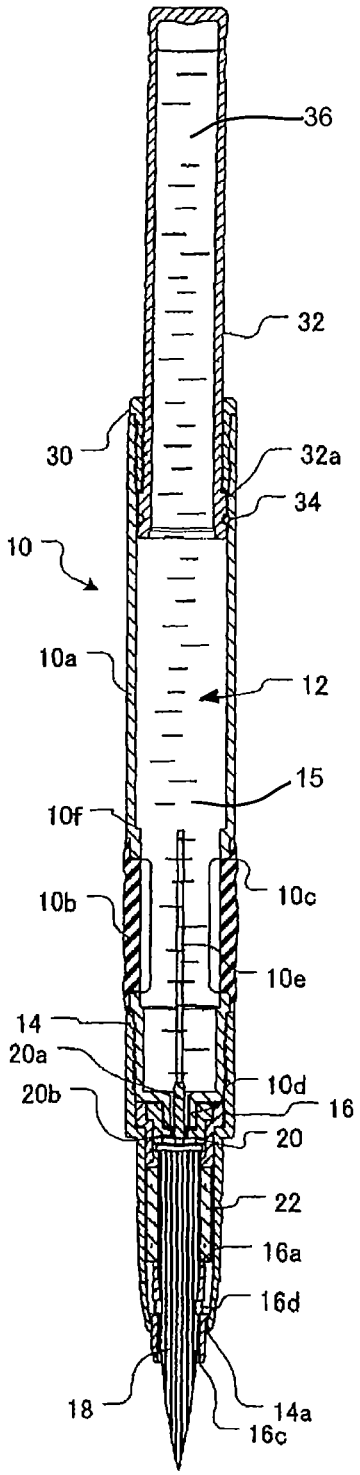
FIG. 4 is a whole longitudinal sectional view of a liquid applicator according to the present invention while in use.
Figure 5C:
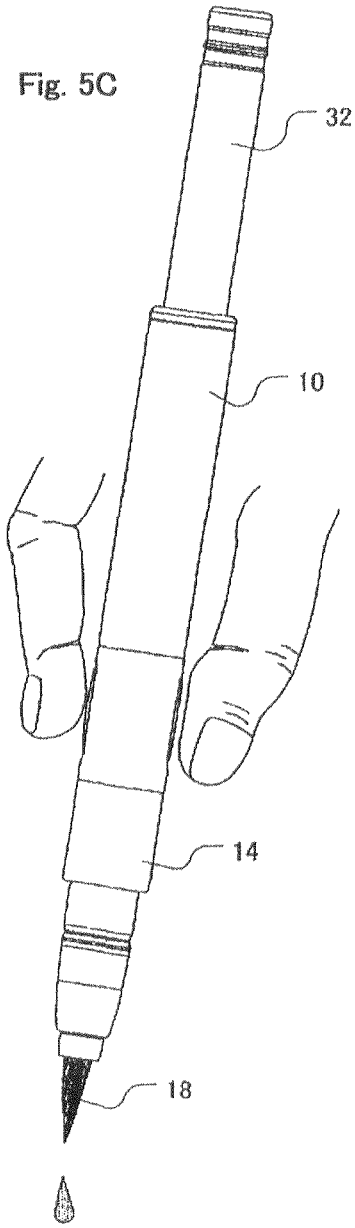
FIG. 5C is a view to illustrate a liquid applicator according to the present invention while in use.

With such operation, the prepared liquid is introduced into and filled in the tank 12 comprising the first and second tank portions 15, 36, as best shown in FIG. 4. While in use, the tip shaft 14 and the main body 10 are coupled by threading and the cap 38 is detached, whereby the liquid can be applied on an object to be applied from the brush 18 while gripping the main body 10 as shown in FIGS. 4 and 5C. At this time, the sliding cylinder 32 remains projecting and thus the main body 10 is easy to grip.

As described above, according to the liquid applicator of the embodiment of the invention, the whole length of the liquid applicator can be decreased to improve its portability by retracting the sliding cylinder 32 while not in use. While in use, on the other hand, the volume capability of the tank 12 can be increased by pulling out the sliding cylinder 32 so that a large amount of liquid can be contained in the tank 12. Further, since the whole length of the liquid applicator can be increased, the liquid applicator is easy to grip by hand so as to improve its handleability.

In order to discharge the liquid more from the brush 18, the flexible portion 10*b* of the main body 10 is pushed to constrict the tank 12 so that the liquid from the tank 12 is moved toward the brush 18. The liquid is introduced from the tank 12 to the columnar portion 20*a* of the inner stopper 20 through a gap, which is formed in the tip end opening 10*d* of the main body 10 and between the tip end opening 10*d* and the columnar portion 20*a* of the inner stopper 20. The liquid thus introduced moves to the brush 18 through the through-hole 20*b* passing over a rear end flange portion of the brush 18, then passes through the brush 18 and applied from the brush 18.

In order to discharge a large amount of liquid from the brush 18, the sliding cylinder 32 is pushed forward so that the liquid of an amount corresponding to the pushed amount is moved from the tank 12 toward the brush 18. When a large amount of liquid is discharged, the liquid passes through the brush 18 and also may pass a path from the brush 18 through the liquid absorber 22 and the second side hole 16*d* for flowing back to the brush 18.

When the liquid in the tank 12 runs out, the threaded coupling of the main body 10 and the tip shaft 14 is released and the liquid is sucked into the tank 12 as described above so as to replenish the liquid. Here, the liquid may be sucked by sinking the tip end of the brush 18 without releasing the threaded coupling of the main body 10 and the tip shaft 14. At this time, the liquid moves toward the tank 12 passing the same path as when being applied, in the opposite direction.

In order to evacuate liquid from the tank 12 after use, the threaded coupling between the main body 10 and the tip shaft 14 is released to discharge the liquid from the tip end opening 10*d*. At this time, the sliding cylinder 32 that remains projecting is pushed forward to reduce the volume capacity of the tank so as to make positive pressure, whereby the liquid in the tank 12 can be discharged in bursts from the tip end opening 10*d*. Instead, the liquid may be discharged from the tip end of the brush 18 without releasing the threaded coupling of the main body 10 and the tip shaft 14.

The sliding cylinder 32 retracts into the main body 10 as described above and the liquid applicator can be stored in such a state. Further, the liquid can be replaced by discharging the liquid from the tank 12 and by sucking another liquid into the tank 12.

As described above, according to the liquid applicator of the embodiment of the invention, the whole length of the liquid applicator can be decreased to improve its portability by retracting the sliding cylinder 32 while not in use. While in use, on the other hand, the volume capacity of the tank 12 can be increased by pulling out the sliding cylinder 32 so that a large amount of liquid can be contained in the tank 12. Further, since the whole length of the liquid applicator can be increased, the liquid applicator is easy to grip by hand so as to improve its handleability.

The invention claimed is:

1. A liquid applicator comprising:

a main body including a main body shaft portion including a side opening and a flexible portion provided on a circumference of a part of the main body shaft portion, a piece of the flexible portion covering the side opening;

a tank for containing a liquid therein;

a tip end applicator body arranged in front of the main body and capable of applying the liquid on an object to be applied; and a sliding cylinder attached to a rear of the main body so as to be slidable with respect to the main body;

the tank comprising a first tank portion and a second tank portion which communicate with each other;

the first tank portion being defined by i) a portion of an interior of the main body that extends forward from a tip end of the sliding cylinder attached to the rear of the main body, and ii) the piece of the flexible portion covering the side opening;

the second tank portion being defined in an entire interior of the sliding cylinder;

the piece of the flexible portion covering the side opening of the first tank portion adapted to be pushed toward a center of the first tank portion to constrict the first tank portion and thereby cause the liquid to be moved toward the tip end applicator body; and the sliding cylinder being adapted to be capable of being pushed into or pulled out of the main body, so that when the sliding cylinder is pushed into the main body, a volume of the second tank portion remains unchanged and a volume of the first tank portion can be reduced and, when the sliding cylinder is pulled out of the main body, the volume of the second tank portion remains unchanged and the volume of the first tank portion can be increased.

2. The liquid applicator according to claim 1, wherein the liquid applicator further includes a tip shaft coupled to a tip end of the main body, the tip end applicator body is fixed in the tip shaft, the tip end of the main body has a tip end opening formed at the tip end thereof, and the main body and the tip shaft are coupled with each other in a disconnectable manner such that the tip end opening can be exposed.

3. A liquid applicator comprising:

a main body including a main body shaft portion including a side opening and a flexible portion provided on a circumference of a part of the main body shaft portion, a piece of the flexible portion covering the side opening;

a tank for containing a liquid therein;

a tip end applicator body arranged in front of the main body and capable of applying the liquid on an object to be applied; and a sliding cylinder attached to a rear of the main body so as to be slidable with respect to the main body;

the tank comprising a first tank portion and a second tank portion which communicate with each other;

the first tank portion being defined by i) a portion of an interior of the main body that extends forward from a tip end of the sliding cylinder attached to the rear of the main body, and ii) the piece of the flexible portion covering the side opening;

the second tank portion being defined in an interior of the sliding cylinder;

the piece of the flexible portion covering the side opening of the first tank portion adapted to be pushed inward at the side opening to constrict the first tank portion to thereby cause the liquid to be moved toward the tip end applicator body; and the sliding cylinder being adapted to be capable of being pushed into or pulled out of the main body, so that when the sliding cylinder is pushed into the main body, a volume of the second tank portion remains unchanged and a volume of the first tank portion can be reduced and, when the sliding cylinder is pulled out of the main body, the volume of the second tank portion remains unchanged and the volume of the first tank portion can be increased, the volume of the second tank portion being substantially equal to the interior of the sliding cylinder.

4. The liquid applicator of claim 3, wherein the liquid applicator further includes a tip shaft coupled to a tip end of the main body, the tip end applicator body is fixed in the tip shaft, the tip end of the main body has a tip end opening formed at the tip end thereof, and the main body and the tip shaft are coupled with each other in a disconnectable manner such that the tip end opening can be exposed.

5. The liquid applicator according to claim 1, wherein the main body shaft portion and the flexible portion are formed as an integrally molded member.

6. The liquid applicator according to claim 3, wherein the main body shaft portion and the flexible portion are formed as an integrally molded member.

7. The liquid applicator according to claim 1, wherein the flexible portion is disposed circumferentially about an outer wall of the main body portion.

8. The liquid applicator according to claim 3, wherein the flexible portion is disposed circumferentially about an outer wall of the main body portion.

* * * * *